US007104899B1

(12) United States Patent
Caserta

(10) Patent No.: US 7,104,899 B1
(45) Date of Patent: Sep. 12, 2006

(54) GOLF PUTTER WITH EXTENDING TRAINING RAIL DEVICE AND ITS ASSOCIATED METHOD OF USE

(76) Inventor: Richard Caserta, 11 N. 2nd St., Apt. 503, Philadelphia, PA (US) 19106

( * ) Notice: Subject to any disclaimer, the term of this patent is extended or adjusted under 35 U.S.C. 154(b) by 0 days.

(21) Appl. No.: 11/027,597

(22) Filed: Jan. 3, 2005

Related U.S. Application Data

(63) Continuation-in-part of application No. 10/828,618, filed on Apr. 22, 2004.

(51) Int. Cl.
*A63B 69/36* (2006.01)

(52) U.S. Cl. ..... 473/236; 473/251; 473/238

(58) Field of Classification Search ..... 473/231–255, 473/257, 258, 260
See application file for complete search history.

(56) References Cited

U.S. PATENT DOCUMENTS

| | | | | | |
|---|---|---|---|---|---|
| 3,021,141 | A * | 2/1962 | Polsky et al. | ..... | 473/236 |
| 3,194,564 | A * | 7/1965 | Swan | ..... | 473/236 |
| 3,384,376 | A * | 5/1968 | Greenlee | ..... | 473/236 |
| 3,667,761 | A | 6/1972 | Palotsee | | |
| 4,291,883 | A * | 9/1981 | Smart et al. | ..... | 473/244 |
| 4,902,014 | A * | 2/1990 | Bontomase et al. | ..... | 473/241 |
| 4,949,971 | A * | 8/1990 | Thornton | ..... | 473/238 |
| 4,953,867 | A * | 9/1990 | Rigsby | ..... | 473/238 |
| 5,213,332 | A * | 5/1993 | Fahy et al. | ..... | 473/243 |
| 5,240,253 | A * | 8/1993 | Cooper | ..... | 473/236 |
| 5,351,961 | A * | 10/1994 | Eulau | ..... | 473/252 |
| 5,447,313 | A | 9/1995 | Finley | | |
| 5,551,695 | A | 9/1996 | Wolk | | |
| 5,709,611 | A * | 1/1998 | Intag | ..... | 473/236 |
| 5,839,974 | A * | 11/1998 | McAllister | ..... | 473/337 |
| 6,117,019 | A * | 9/2000 | Taylor | ..... | 473/46 |
| 6,296,574 | B1 * | 10/2001 | Kaldis | ..... | 473/236 |
| 6,821,212 | B1 * | 11/2004 | Fowler et al. | ..... | 473/236 |
| 2004/0147332 | A1 * | 7/2004 | Engdahl | ..... | 473/236 |

* cited by examiner

*Primary Examiner*—Sebastiano Passaniti
(74) *Attorney, Agent, or Firm*—LaMorte & Associates

(57) ABSTRACT

A golf putter assembly and its associated method of use. The putter assembly has a putter head disposed at the end of a traditional shaft. The putter head has a striking surface for striking a golf ball. A rod is provided that extends forward of the striking surface. The rod has a first end, a second end and at least one curved section in between those two ends. The rod can be rotated into different orientations prior to being attached to the putter head. As the rod is rotated, the perceived curvature of the rod that is observed by a golfer holding the putter changes. A golfer can therefore selectively change the perceived curvature of the rod to match the natural curvature inherent in that golfer's putting swing.

15 Claims, 5 Drawing Sheets

GOLF PUTTER WITH EXTENDING TRAINING RAIL DEVICE AND ITS ASSOCIATED METHOD OF USE

RELATED APPLICATIONS

This application is a continuation-in-part of co-pending application Ser. No. 10/828,618, filed Apr. 22, 2004, entitled Golf Putter Training Device And Method.

BACKGROUND OF THE INVENTION

1. Field of the Invention

In general, the present invention relates to the structure of putters that are used in playing the game of golf. More particularly, the present invention is directed toward golf putters with secondary visual and/or tactile aids that can be used in developing a proper putting swing.

2. Description of Related Art

In the game of golf, the object of the game is to get a golf ball into a distant golf hole with as few strokes of a golf club as possible. In golf, the hole is positioned on a green of finely manicured grass. When a golf ball lands on the green, it is most commonly struck toward the hole with a putter. A putter is a golf club that has a generally flat striking surface. Thus, when a golf ball is struck with the putter, the golf ball tends to roll forward on the green rather than fly up into the air.

The prior art is replete with many different designs for putters and putter heads. In this collection of designs, there exist many golf putters that have features that are intended to help a golfer practice proper putting techniques.

When a golfer putts, the golfer wants to strike the golf ball flush in the center of the putter, without having the putter experience any lateral movement relative the ball. That is, the head of the putter should only be traveling in the exact direction the golfer wants the golf ball to travel when the putter strikes the golf ball. In order to consistently putt in this manner, a golfer must practice his putting and his golf swing with the putter.

In the prior art, golf putters have been created that contain guide rods. The guide rods extend from the golf putter and provide a visual and/or tactile reference guide that can be used to practice putting. For example, in U.S. Pat. No. 5,447,313, to Finley, entitled Golf Putter With Foldable Aiming Device, a putter is shown having a rod that extends behind the face of the putter at a perpendicular. The rod provides a visual alignment tool to a golfer practicing putting. By aligning the rod with the golf ball and keeping the rod in alignment with the golf ball throughout the putter's swing, a person can train himself/herself to properly swing the putter.

In U.S. Pat. No. 3,667,761, to Palotsee, entitled Golf Putter With Aligning Device, another putter is shown that uses a rod as a visual aid. In this patent, the rod extends out in front of the putter's face and passes over the top of a golf ball as the putter strikes the golf ball. Again, the rod provides a visual alignment tool to a person practicing putting. By aligning the rod with the golf ball and keeping the rod in alignment with the golf ball throughout the putter's swing, a golfer can train themselves to properly swing the putter.

In U.S. Pat. No. 5,551,695, to Wolk, entitled Apparatus For Training A Golfer To Properly Putt A Golf Ball, yet another putter design is shown that uses rods. In the Wolk design, two parallel rods extend from the front of the putter's face. The rods provide both a visual indicator and a tactile indicator for a golfer. If a golfer swings straight, the rods travel straight and the golf ball strikes the putter's face without touching the rods. If a golf swing is not straight, the rods will not travel straight and the rods will strike the golf ball.

A problem associated with prior art putters that use guide rods is that the guide rods are usually very short and straight. The guide rods are therefore only useful guides when the face of the golf club is very close to the golf ball. However, in reality, most golfers have a putting swing where the head of the putter travels more than a foot before it contacts the golf ball. Prior art guide rods are only a few inches long. Thus, short guide rods are not useful guides throughout the entire putting swing. Furthermore, many golfers have a putting swing that curves slightly as they rotate. Thus, the head of the putter moves along a slightly curved path as the putter head travels toward the golf ball. In the prior art, guide rods are straight. Prior art guide rods therefore do not accurately align with the path of travel of the putter and can therefore cause a golfer to misalign a putt.

A need therefore exists for a golf putter that provides a long, curved guide rod that acts as an accurate visual and tactile reference throughout an entire putting swing. This need is met by the present invention as it is described and claimed below.

SUMMARY OF THE INVENTION

The present invention is a golf putter assembly and its associated method of use. The putter assembly has a putter head disposed at the end of a traditional shaft. The putter head has a striking surface for striking a golf ball. A rod is provided that extends forward of the striking surface. The rod has a first end, a second end and at least one curved section in between those two ends.

The rod can be rotated into different orientations prior to being attached to the putter head. As the rod is rotated, the perceived curvature of the rod that is observed by a golfer holding the putter changes. A golfer can therefore selectively change the perceived curvature of the rod to match the natural curvature inherent in that golfer's putting swing.

The rod therefore presents a visual and tactile guide to the golfer that helps the golfer create straight putts, even if the golfer's putting motion is produces a slighted curved movement in the travel path of the putter.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

In the field of golf putters, there are many different designs and styles. The illustrated embodiment of the present invention golf putter shows a golf putter of only one traditional style. It will be understood that the embodiment of the putter illustrated is merely exemplary and that the features of the present invention putter can be adapted for use on most any known putter design.

Figure 1:
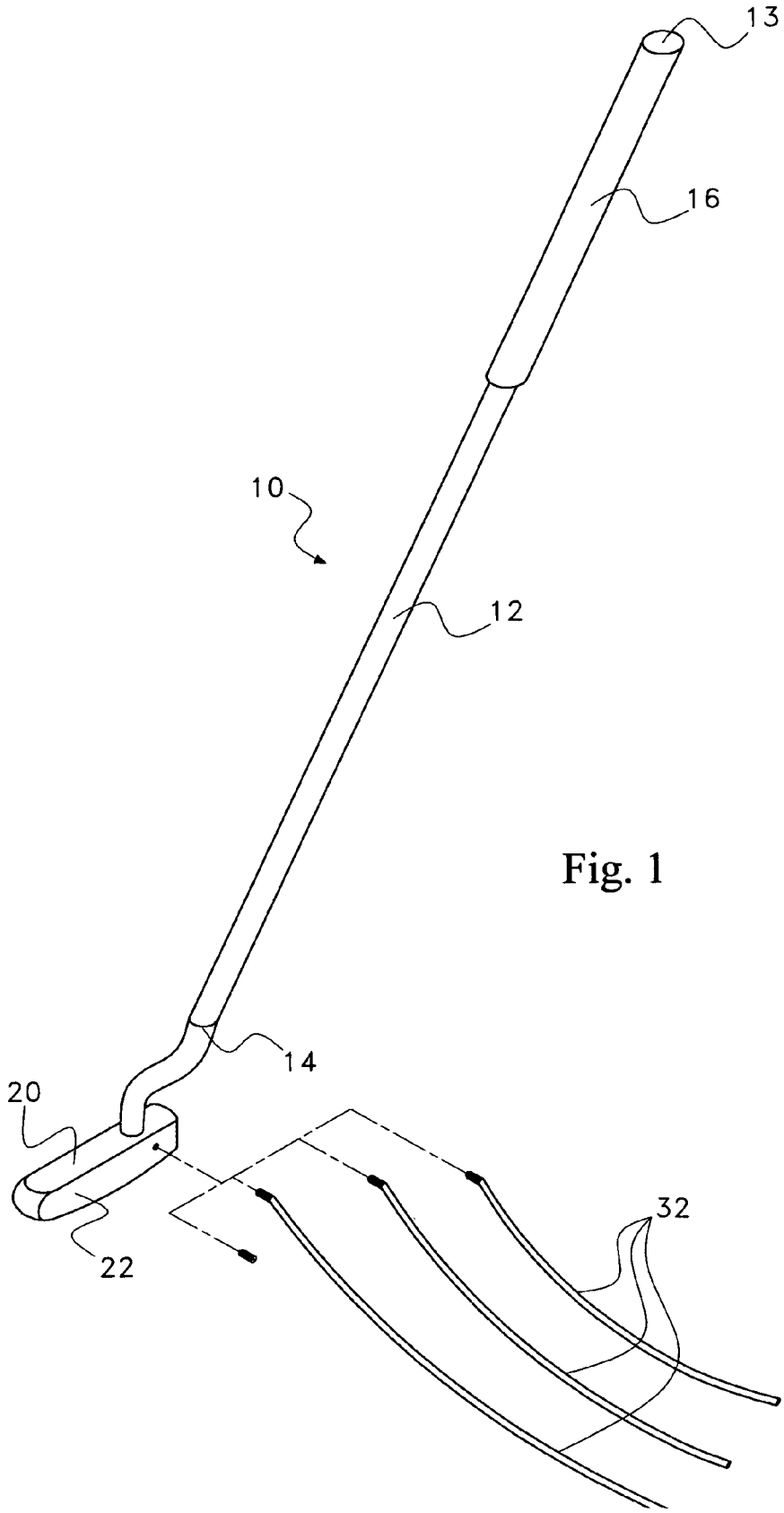
FIG. 1 is a perspective view of an exemplary embodiment of a golf putter.

Referring to FIG. 1, there is shown a putter 10. The putter 10 has a shaft 12 with a top end 13 and a bottom end 14. The top end 13 of the shaft 12 terminates with a grip handle 16. A putter head 20 is disposed at the bottom end 14 of the grip handle 16. The putter head 20 has a generally flat striking surface 22 that is used to strike a golf ball when putting.

Figure 2:
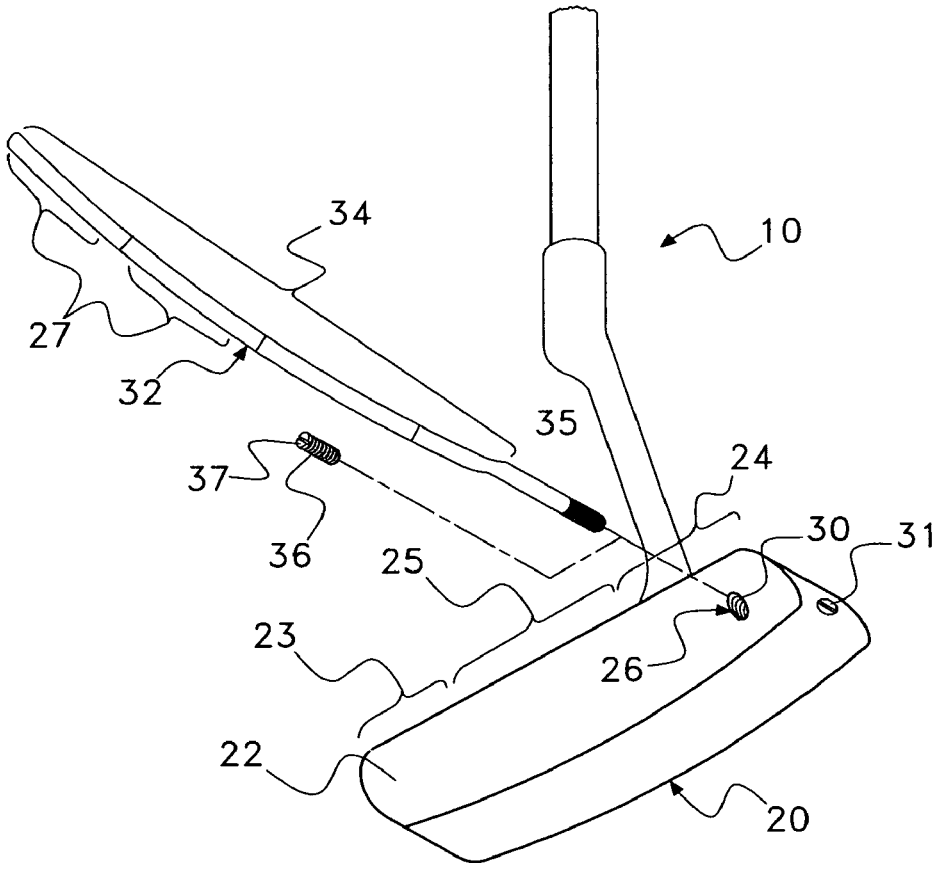
FIG. 2 is a perspective view of a putter head shown in conjunction with a training rod and weight plug.

Referring to FIG. 2, it can be seen that the striking surface 22 of the putter head 20 has a toe section 23, a heel section 24 and a central section 25 disposed in between the toe section 23 and the heel section 24. Ideally, a golfer wants to strike a golf ball with the center section 25 of the striking surface 22. It is also desired that the plane of the striking surface 22 be perfectly perpendicular to the desired line of travel for the golf ball at the moment of golf ball impact.

A female receptacle 26 is shown on the striking surface 22 of the putter head 20. In the shown embodiment, the connection receptacle is a blind bore 30 having a spline shaped exterior wall 28 that is disposed in the heel section 24 of the striking surface 22. However, it should be understood that in an alternate embodiment, the female receptacle 26 can be located near the toe section 23 of the striking surface 22, as will be later explained.

Within the female receptacle 26 is located either a detent ball or a set screw. A set screw 31 is shown in the exemplary embodiment. The set screw 31 is disposed in a threaded hole that communicated with the spline shaped exterior wall 28 of the blind bore 30.

A training rod 32 is provided. The training rod 32 is preferably between six inches long and three feet long. The training rod 32 has an opposing first end and second end. However, the training rod 32 is not linear between its first and second end. Rather, the training rod contains at least one curved section 34. The curved section 34 can extend the entire length of the training rod 32, or can extend only across a portion of the training rod 32.

The training rod 32 is preferably tubular, so as to be as lightweight as possible. Although the training rod 32 can be a metal tube, such as aluminum, the training rod 32 can also be a synthetic material, such as plastic or a carbon composite, to make the training rod 32 more resistant to accidental bending. Alternatively, the training rod can be made of a coiled spring so as to be highly flexible and nearly impervious to bending damage.

The training rod 32 terminates with a male coupling 35 at its first end. The male coupling 32 has a spline shape that corresponds to the shape of the blind bore 30 in the striking surface 22 of the putter head 20. The male coupling 35 therefore intermeshes with the shape of the blind bore 30 as it is received within the blind bore 30. When the male coupling 35 at the end of the training rod 32 is inserted into the blind bore 30, the training rod 32 becomes cantilevered and protrudes in front of the striking surface 22. However, the male coupling 35 at the end of the training rod 32 can be rotated into many different positioned prior to being inserted into the blind bore 30 on the striking surface 22 of the of the putter head 20. The curvature of the training rod 32 relative to the a horizontal plane can therefore be selectively altered by rotating the threaded rod 32 prior to attachment with the putter head 20, as is further explained.

Figure 3:
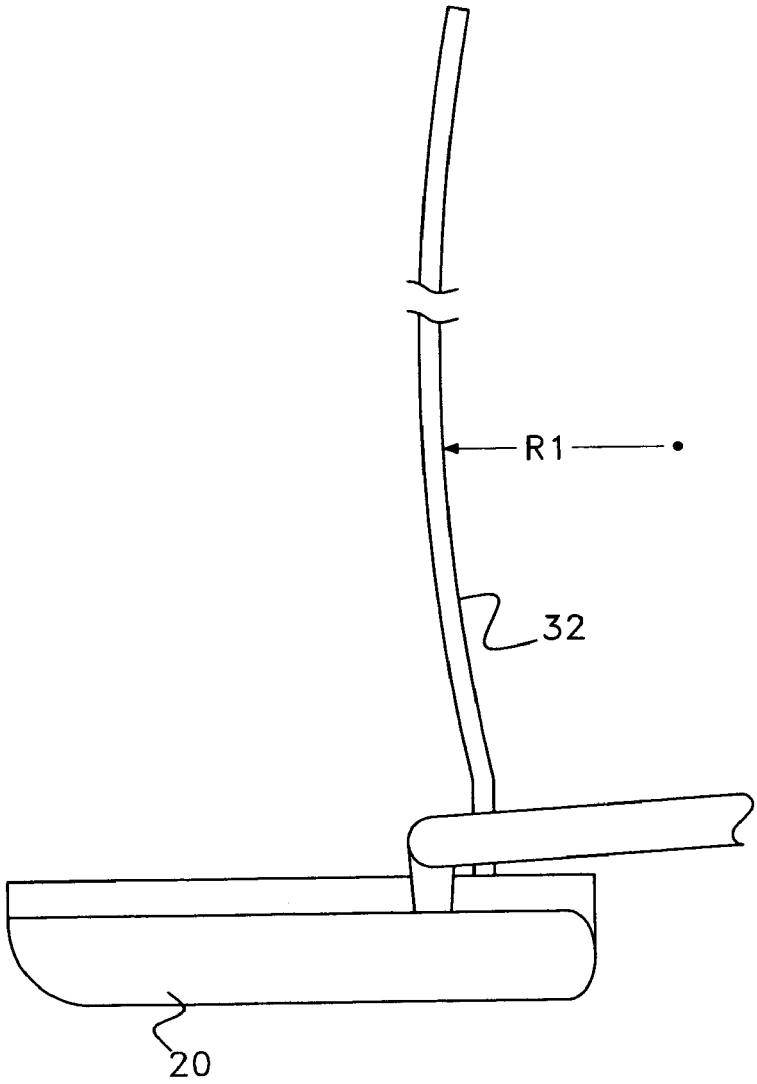
FIG. 3. is a top view of a putter head connected to a training rod presenting a curved shape.

Referring to FIG. 3, a training rod 32 is shown that has a first radius of curvature R1. If the training rod 32 is attached to the putter head 20 so that the full radius of curvature lays in a horizontal plane. The golfer looking down at the training rod will see the full curvature of the training rod 32.

Figure 4:
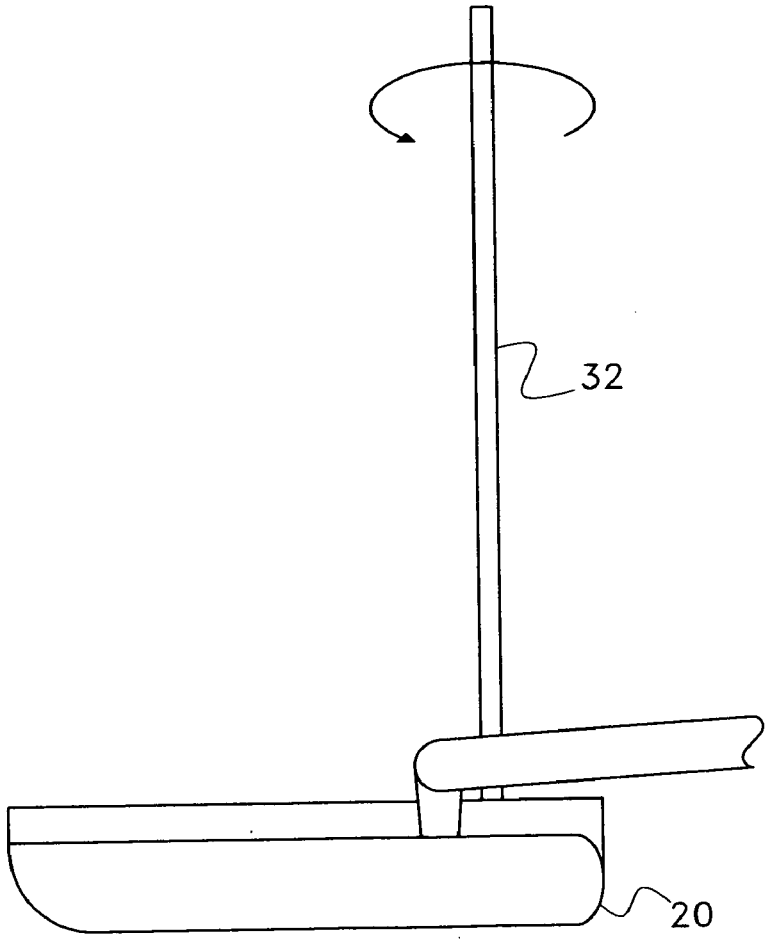
FIG. 4 is a top view of a putter head connected to a training rod presenting a straight shape.

However, as is shown by FIG. 4, if the training rod 32 is rotated 90 degrees so that the radius of curvature lays in a vertical plane, then a golfer looking down at the training rod will see no curvature. Rather, the training rod 32 will appear to be straight.

Returning to FIG. 2, it will be understood that the degree of curvature in the training rod 32 that is perceived by a golfer is dependent upon the rotational position of the training rod 32 as it is attached to the putting head 20. Consequently, although the training rod 32 is static, it can present a large number of different curvatures to the golfer.

In the shown embodiment, the training rod 32 attaches to the striking surface 22 of the putter 10. However, it will be understood that the training rod 32 can pass along the top of the putter head 20 or even attach to the shaft 12 of the putter 10. The point of attachment is not of great importance. Rather, what is of importance is that the training rod 32 extends forward of the putter head 20 and that the training rod 32 can be selectively rotated.

In FIG. 1, training rods 32 of different lengths are shown. Although the training rods have different lengths, it is preferred that the various training rods 32 have close to the same weight.

To use the putter 10, a golfer selects a training rod 23 having a length at least as long as the putting swing the golfer wants to practice. The golfer then sets the selected training rod 23 into the putter head 20 so that the curvature of the training rod 32 that is observed by the golfer matches the natural curvature of the golfer's putting stroke. The perceived curvature of the training rod 32 can be selectively changed by rotating the training rod 32 to different orientations prior to the attachment of the training rod 32 to the putter head 20.

The same effect can also be created using a single training rod. Referring back to FIG. 2 a single training rod 24 that is color coated in various sections 27 along its length. Different colors are used along the length of the training rod 24. Depending on the golfer's swing and how far of a put is to be made, a golfer can used the colored sections 27 to gage the swing of the putter 10.

In FIG. 2, an optional weighted plug 36 is also shown. The weighted plug 36 has generally the same weight as any of the training rods 32. Thus, the weighted plug 36 is preferably made from a dense material, such as steel or tungsten. The weighted plug 36 has an exterior that that matches the shape and size of the male coupling 35 at the end of a training rod 32. Consequently, the weighted plug 36 can be selectively set into the female receptacle 26 on the striking surface 22 of the putter head 20.

Since both the training rod 32 and the weighted plug 36 are the same weight, it will be understood that regardless of whether the weighted plug 36 or the training rod 32 is attached to the putter head 20, the weight of the putter head 20 remains constant. Thus, the swing characteristics associated with the putter head 20 remain relatively constant regardless of whether the training rod 32 or the weighted plug 36 is attached to the putter head 20.

When the weighted plug 36 is set into the female receptacle 26, the tip 37 of the weighted plug 36 lay flush in the striking surface 22 of the putter head 20. Thus, the putter head 20 conforms to all USPGA rules and can be used in regulation play.

When the weighted plug 36 is removed and a training rod 32 is added to the putter head 20, the putter 10 becomes a non-regulation training putter that can be used for practice. However, the weight, feel and swing characteristics of the putter 10 remain the same.

Figure 5:
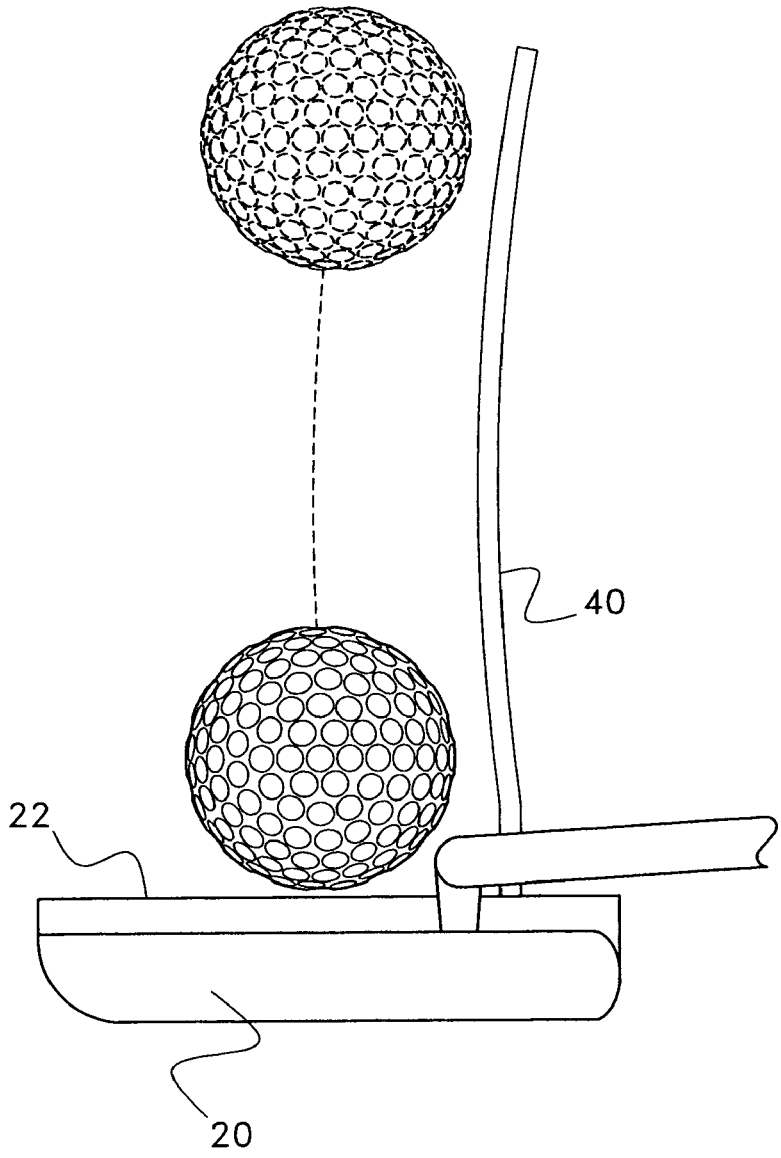
FIG. 5 is a perspective view of a putter head with training rod engaging a golf ball.

Referring to FIG. 5, it can be seen that when the training rod 32 is attached to the putter head 20, the training rod 32 extends forward from the striking surface 22 of the putting head 20. The training rod 32 is supported a predetermined height above the ground. The positional height of the training rod 32 is calculated so that during a golf swing the training rod 32 will be positioned adjacent the center of a golf ball.

The training rod 32 extends from the striking surface 22 of the putter head 20 in the heel section 24 of the putter head 20. The training rod 32 is positioned so that the training rod 32 will be between ¼ inch and ½ inch from the side of a golf ball when the golf ball strikes the exact center of the striking surface 22. It will therefore be understood that the training rod 32 will only contact the golf ball, if a golfer's swing causes the golf ball to travel toward the heel section 24 of the putter head 20. Thus, the training rod 32 provides a tactile guide that helps a golfer putt straight.

As has been earlier mentioned, in an alternate embodiment, the training rod 32 can be attached to the putter head 20 in the toe section 23 of the putter head 20. In such an alternate embodiment, it will be understood that the training rod 32 will only contact the golf ball if a golfer's swing causes the golf ball to travel toward the toe section 23 of the putter head 20.

With most golfers, the error that occurs in their putting swing is that the golf ball travels toward the heel section 24 of the putter head 20 during the swing. It is for this reason that the shown embodiment has the training rod 32 in the heel section 24 of the putter head 20. However, if a golfer has the opposite problem, a golfer can use the embodiment of the present invention putter 10 where the training rod 32 extends from the toe section 23 of the putter head 20.

In either embodiment, it is preferred that only one training rod 32 extends from the striking surface 22 of the putter head 20. If two training rods were used, a golfer would have to approach the golf ball in an unusual manner and lower the golf club over the golf ball so that the training rods do not touch the golf ball. This would cause the approach to the golf ball during training to be different from the approach of the golf ball during regulation play. However, by using only a single training rod 32, a golfer can move the putter 10 laterally next to the golf ball and therefore approach a golf ball in the same manner they would if the training rod 32 were not present. This creates consistency between training to putt and actually putting during a game.

The present invention putter enables a golfer to attach a training rod to the striking face of the putter when the golfer is practicing golf. The training rod provides both a tactile and visual guide that helps a golfer create and perfect a straight putting swing. The use of a single training rod also enables a golfer to approach a golf ball and position the putter adjacent the golf ball in the traditional manner. Thus, the approach to the golf ball during practice can be kept consistent with the approach to the golf ball during regulation play.

When the training rod is in place, the putter head and the training rod have a predetermined combined weight. A weighted plug is provided that matches the weight of the training rod. In this manner, when the training rod is removed, the weighted plug can be put in its place and the weight of the putter head remains constant. When the weighted plug is set in place, the putter becomes a regulation putter. The putter can therefore be used in practice or regulation play and a golfer finds great consistency in the putter regardless of whether it is configured for practice or configured for regulation play.

It will be understood that the embodiments of the present invention putter that are described and illustrated are merely exemplary and that a person skilled in the art can make many variations to those embodiments. For example, the shape of the putter head can be varied to match most any known design. The method of attaching the training rod to the putter head can be varied from the bore configuration shown. Alternate connection receptacles, such as a smooth bore with lateral setscrew, can be used in place of the threaded bore configuration shown. All such variations, modifications and alternate embodiments are intended to be covered by the scope of the present invention as defined by the claims.

What is claimed is:

1. A golf putter assembly, comprising:

a shaft having a first end and a second end;

a handle disposed at said first end of said shaft;

a putter head disposed at said second end of said shaft, said putter head having a striking surface for striking a golf ball;

a connection receptacle disposed on said striking surface of said putter head; and a rod extending forward of said striking surface, said rod having a having a first end, a second end, a coupling at said second end, predetermined weight and at least one curved section between said first end and said second end, wherein said coupling at said second end of said rod is received within said connection receptacle on said striking surface of said putter head.

2. The assembly according to claim 1, wherein said rod can be selectively rotated relative to said striking surface, said assembly further including a locking mechanism for locking said rod into a selected rotated position relative said striking surface.

3. The assembly according to claim 1, wherein said coupling fits into said connection receptacle in a plurality of predetermined rotational positions.

4. The assembly according to claim 1, wherein said rod has a length of between six inches and three feet.

5. The assembly according to claim 1, wherein said striking surface of said putter head has a toe section, a heel section and a central section disposed between said toe section and said heel section, wherein said rod extends forward of said heel section.

6. The assembly according to claim 1, further including a plug having a weight generally equal to said rod that can be selectively attached to said putter head in place of said rod.

7. The assembly according to claim 6, wherein said connection receptacle is a shaped bore and both said second end of said rod and said plug have exterior surfaces that can be received and engaged by said shaped bore.

8. A method of altering a configuration of a golf putter for use in training, said method comprising the steps of:

providing a putter having a striking face for striking a golf ball;

providing a rod of a predetermined weight, wherein said rod has at least one curved section that presents a predetermined curvature in a horizontal plane;

attaching said rod to said putter so that said rod extends forward of said striking face; and selectively rotating said rod relative to said putter to selectively alter said predetermine curvature presented in the horizontal plane.

9. The method according to claim 8, wherein said step of attaching said rod to said putter includes inserting one end of said rod into a receptacle on said striking face of said putter.

10. The method according to claim 8, wherein said rod has a length of between six inches and three feet.

11. A putter head assembly, comprising:

a striking surface for striking a golf ball, said striking surface having a toe region, a heel region and a center region disposed between said toe region and said heel region;

a receptacle disposed in said striking surface;

a rod having a first end and a second end, wherein said rod has at least one curved section disposed between said first end and said second end, wherein said second end of said rod can be selectively received within said receptacle in a plurality of rotated positions, thereby causing said rod to protrude forward from said striking surface in one of a plurality of possible orientations.

12. The assembly according to claim 11, further including a locking mechanism for locking said second end of said rod into a selected one of said plurality of rotated positions.

13. The assembly according to claim 11, further including a weighted plug that has a weight generally equal to that of said rod, wherein said weighted plug is sized to be selectively received within said receptacle in place of said rod.

14. The assembly according to claim 11, wherein said receptacle is disposed in said heel section of said striking surface.

15. The assembly according to claim 11, wherein said receptacle is disposed in said toe section of said striking surface.

* * * * *